US009993720B1

(12) United States Patent
Carroll

(10) Patent No.: US 9,993,720 B1
(45) Date of Patent: Jun. 12, 2018

(54) DICE ANGLE GAME

(71) Applicant: Christopher J. Carroll, Peoria, IL (US)

(72) Inventor: Christopher J. Carroll, Peoria, IL (US)

( * ) Notice: Subject to any disclaimer, the term of this patent is extended or adjusted under 35 U.S.C. 154(b) by 0 days. days.

(21) Appl. No.: 15/458,396

(22) Filed: Mar. 14, 2017

Related U.S. Application Data

(60) Provisional application No. 62/322,002, filed on Apr. 13, 2016.

(51) Int. Cl.

| | |
|---|---|
| ***A63F 7/30*** | (2006.01) |
| ***A63F 9/04*** | (2006.01) |
| ***A63F 7/36*** | (2006.01) |
| ***A63B 67/06*** | (2006.01) |

(52) U.S. Cl.
CPC ..... *A63F 7/30* (2013.01); *A63B 67/06* (2013.01); *A63F 7/36* (2013.01); *A63F 9/0402* (2013.01); *A63F 2007/3005* (2013.01); *A63F 2007/3625* (2013.01)

(58) Field of Classification Search
CPC ... A63B 67/06; A63F 7/30; A63F 7/36; A63F 2007/3005; A63G 9/0402
See application file for complete search history.

(56) References Cited

U.S. PATENT DOCUMENTS

| | | | | | |
|---|---|---|---|---|---|
| 687,989 | A * | 12/1901 | Kelly | A63F 7/0005 | 273/123 R |
| D232,569 | S * | 8/1974 | Adams | D21/340 | |
| 4,501,426 | A | 2/1985 | Seitz | | |
| 5,074,556 | A * | 12/1991 | Loeppky | A63F 7/0668 | 273/108.5 |
| 5,082,288 | A | 1/1992 | Swartz | | |
| D347,026 | S * | 5/1994 | Young | D21/318 | |
| 7,204,487 | B1 * | 4/2007 | Pohl | A63F 7/06 | 273/108.1 |
| D604,772 | S * | 11/2009 | Tower | D21/318 | |
| 2012/0202609 | A1 * | 8/2012 | Williams | A63D 15/00 | 473/20 |
| 2014/0138913 | A1 * | 5/2014 | Morley | A63F 3/00157 | 273/274 |

* cited by examiner

*Primary Examiner* — Michael Dennis
(74) *Attorney, Agent, or Firm* — Philip L. Bateman

(57) ABSTRACT

A dice angle game is played on an apparatus that preferably has a flat playing surface, two side walls, two end walls, two barriers, scoring areas between the barriers and the adjacent end walls, and a plurality of dice. The game is played by rolling a dice against a side wall and trying to have it land in a scoring area.

5 Claims, 4 Drawing Sheets

DICE ANGLE GAME

CROSS-REFERENCE TO RELATED APPLICATION

This application claims the benefit of U.S. Provisional Application Ser. No. 62/322,002, Apr. 13, 2016.

FIELD OF THE INVENTION

This invention relates to games utilizing a board apparatus and polyhedral dice. More particularly, the invention relates to a game in which a plurality of dice are pitched in an attempt to circumnavigate barriers to land in a specific scoring region upon the board apparatus.

BACKGROUND OF THE INVENTION

Many sports and games involve pitching, throwing, sliding, or bouncing a projectile towards a scoring region identified down range from the participant throwing the projectile. Examples of such games include darts, bowling, horseshoes, bean bags (also known as cornhole), shuffle board, bocce ball, and curling.

There are many board game that simulate these well known sports and games. Some of the games utilize dice, spinners, shuffled decks of option cards, or other random number generators to select a play option. As one example, Seitz, U.S. Pat. No. 4,501,426, Feb. 26, 1985, simulates the game of bowling in which both dice and cards are employed to select the outcome of a bowling ball rolling down a lane towards an array of pins. As a second example, Swartz, U.S. Pat. No. 5,082,288, Jan. 21, 1992, simulates the game of horseshoes in which both dice and a specialized game board are used to select the outcome of pitching a horseshoe towards a peg in the ground.

Whereas some games are based on pure chance or mental skills, games that require physical skill are more attractive to many. The requirement of physical skill makes the games attractive to those players who wish to become more proficient by repeated play. Proficiency in such games is improved through the development of accuracy, throwing style, velocity, rotation, and other techniques.

Despite the large number of board games currently available, there continues to be a demand for a new board game that requires physical skill and that rewards a player for acquiring proficiency. More particularly, there is a demand for a dice angle game in which skill is required to throw dice in such a way that they land in a scoring area.

SUMMARY OF THE INVENTION

The general object of this invention is to provide an entertaining and competitive board game that requires physical skill and that rewards a player for acquiring proficiency. A more particular object is to provide a dice angle game in which skill is required to throw dice in such a way that they land in a scoring area.

I have invented a new board game apparatus for playing a dice angle game. The apparatus comprises: (a) a playing surface with two sides and two ends; (b) two side walls along the sides of the playing surface; (c) two end walls along the ends of the playing surface, the side walls and the end walls defining an enclosed playing area with an open top; (d) two barriers at fixed positions within the playing area, each barrier being spaced apart from an adjacent end wall and being positioned an equal distance from each side wall; (e) two demarcated scoring areas, each scoring area being located between a barrier and an adjacent end wall; and (f) a plurality of dice.

The board game of this invention is entertaining and competitive, requires physical skill, and rewards a player for acquiring proficiency.

DETAILED DESCRIPTION OF THE INVENTION

Figure 1:
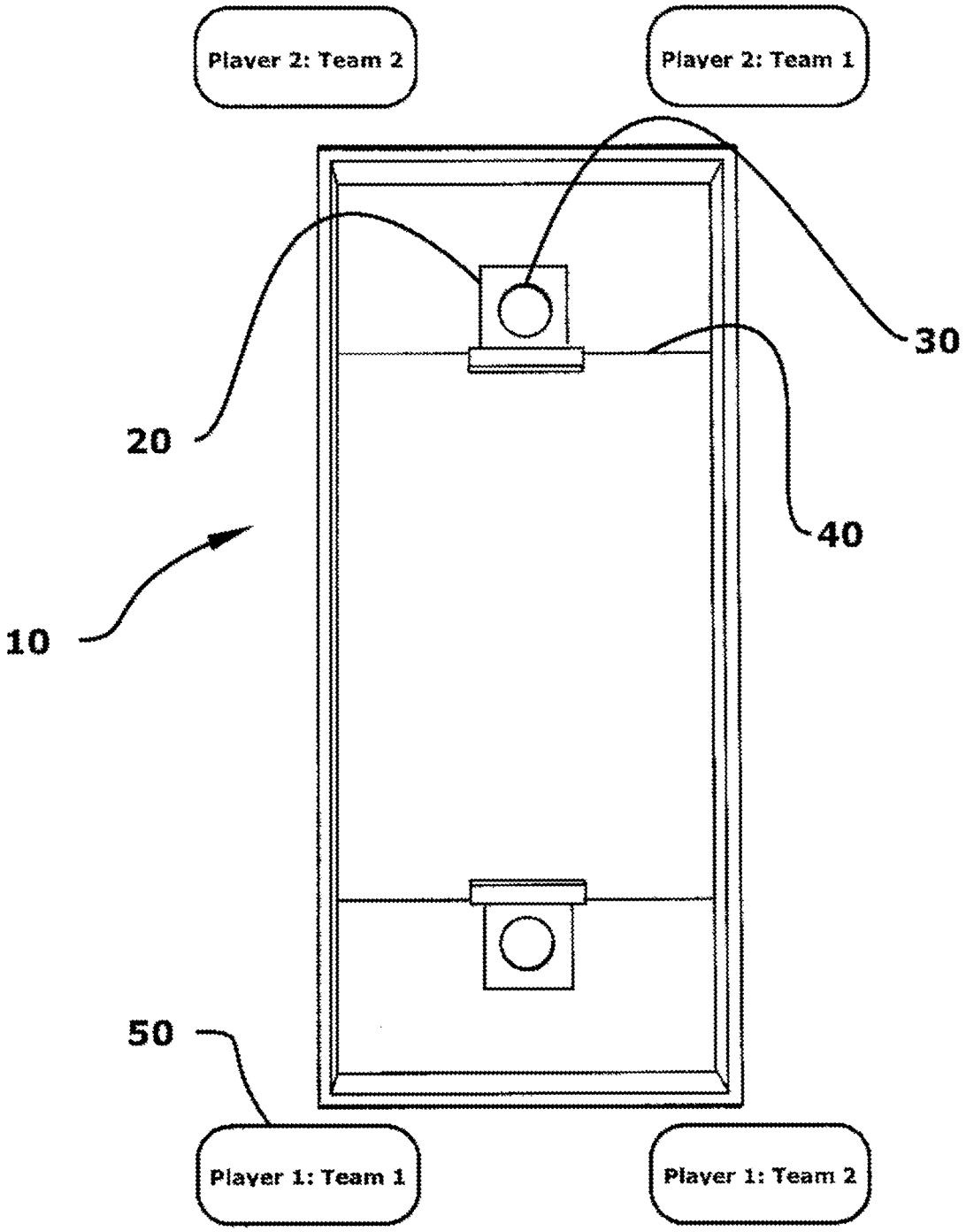
FIG. 1 is a top view of a preferred embodiment of the board game.
Figure 2:
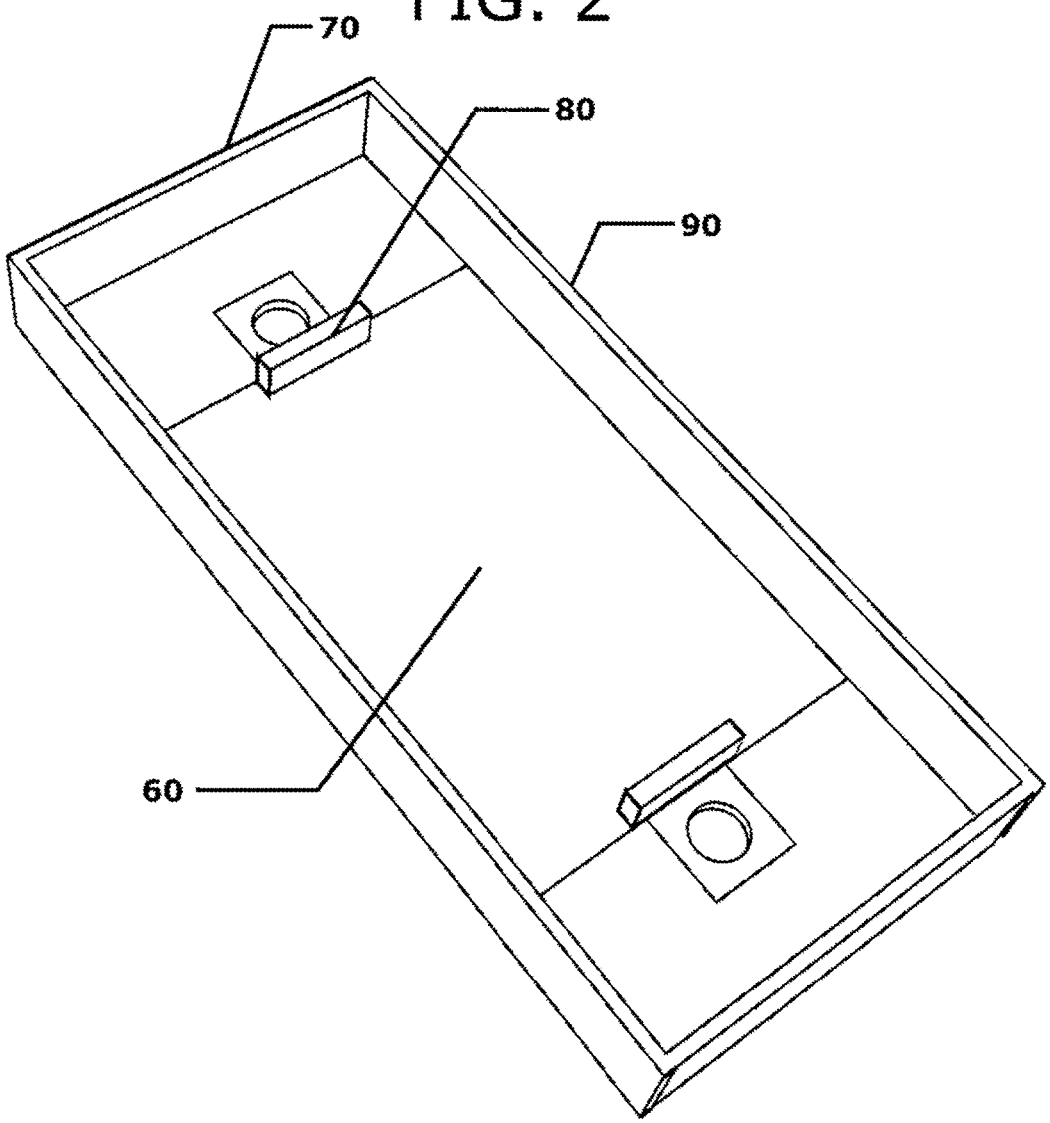
FIG. 2 is a perspective view thereof.
Figure 3:
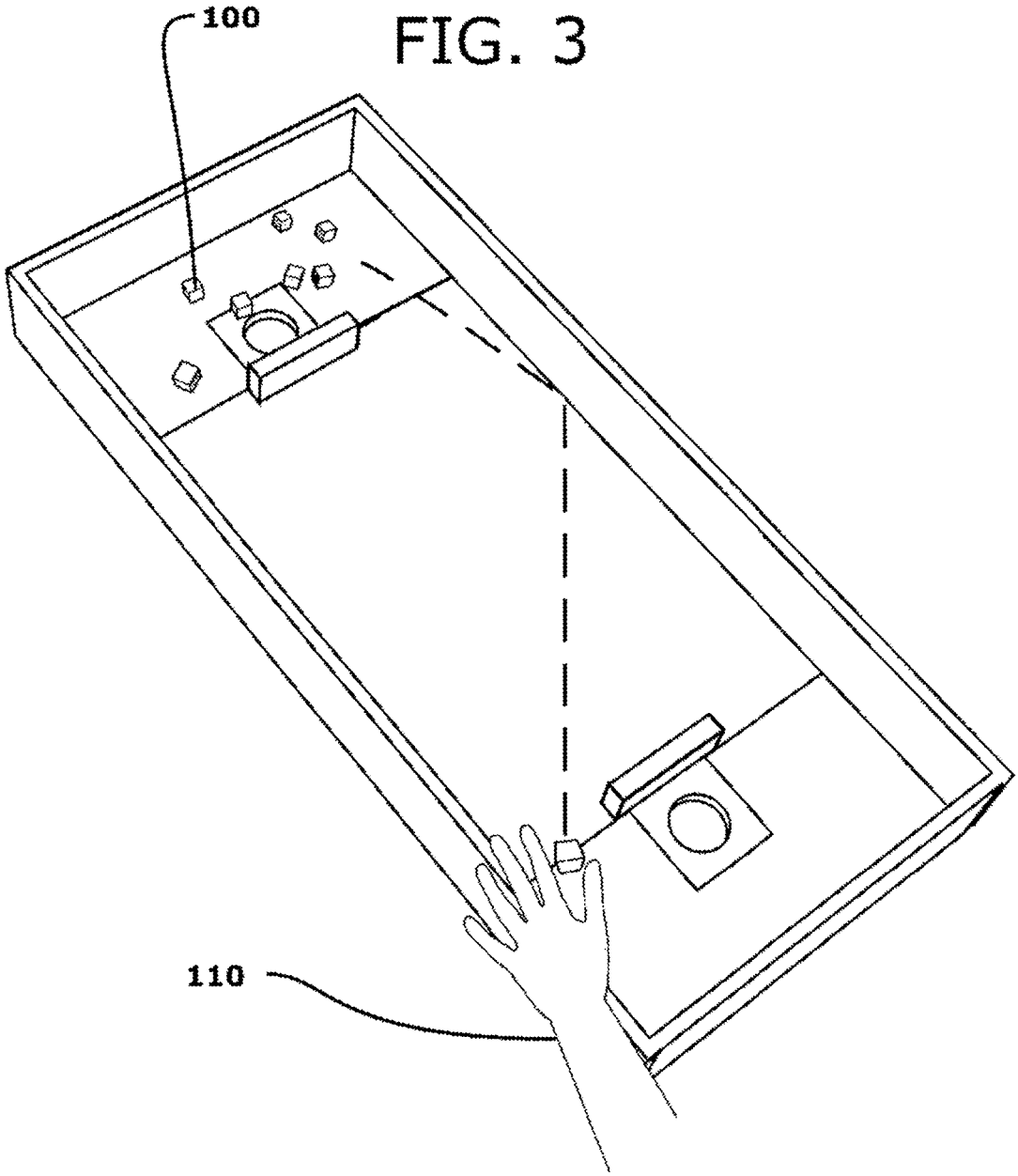
FIG. 3 is a perspective view thereof with the addition of polyhedral dice to illustrate the game play.

The invention is best understood by reference to the drawings. Referring first to the FIGS. 1 to 3, a preferred embodiment of the board apparatus 10 of this invention comprises a rectangular playing surface 60 enclosed within two end walls 70 (also known as back walls) and two side walls 90. Other shapes are also suitable. For example, other shapes with straight walls such as trapezoids are suitable. In addition, shapes with curved walls such as ovals or circles are also suitable.

The apparatus in generally about one to two feet in width and about two to six feet in length. Larger dimensions are suitable, but are often undesirable because of the storage room required. When the playing surface is rectangular, the length of the side walls are generally about two to five times the length (width) of the end walls.

The playing surface is preferably flat. However, uneven surfaces having undulations and the like are also suitable.

The playing surface contains at least two scoring areas. In the embodiment shown, a square scoring area 20 is adjacent each end wall and is protected from direct access by a barrier 80. The barrier is preferably a short wall section that is parallel to the end wall and is equidistant from the side walls. The scoring area is demarcated by lines, color, or other indicia. Additional scoring is achieved by entering a round scoring recess 30 contained within each scoring area 20.

The heights of the end walls, side walls, and barrier are preferably equal. However, unequal heights are also suitable.

Dice 100 are thrown from behind one back wall toward the opposite scoring area. The word "dice" is used herein to include both the singular and the plural. The location in which a player stands relative to the board apparatus 10 is defined as the player location 50. A foul line 40 runs through each barrier to designate the point at which a dice must be thrown.

The apparatus is generally made of wood, plastic, or other durable material. Padded materials are added to the playing surface and to the interior walls if desired.

The dice angle game is played by placing the board apparatus 10 on a horizontal surface with two players on opposing teams playing from a player location 50 alternating throws until the dice are exhausted. The horizontal surface is preferably elevated, such as a table or countertop. When a player 110 receives a turn, he rolls the dice along the playing surface so that it bounces once off a side wall. He attempts to have the dice come to rest in the scoring area behind the barrier at the opposite end. When rolling the dice, the player must release it before crossing an invisible latitudinal foul line that passes through the barrier closest to him.

The embodiment of the board apparatus shown uses cubic dice without any indicia. However, dice with indicia on one or more faces are used if desired. Non-cubic, polyhedral dice having a different number of facets are also used if desired. Using non-cubic dice provides a different rolling action and a different ricochet action off the walls.

Figure 4:
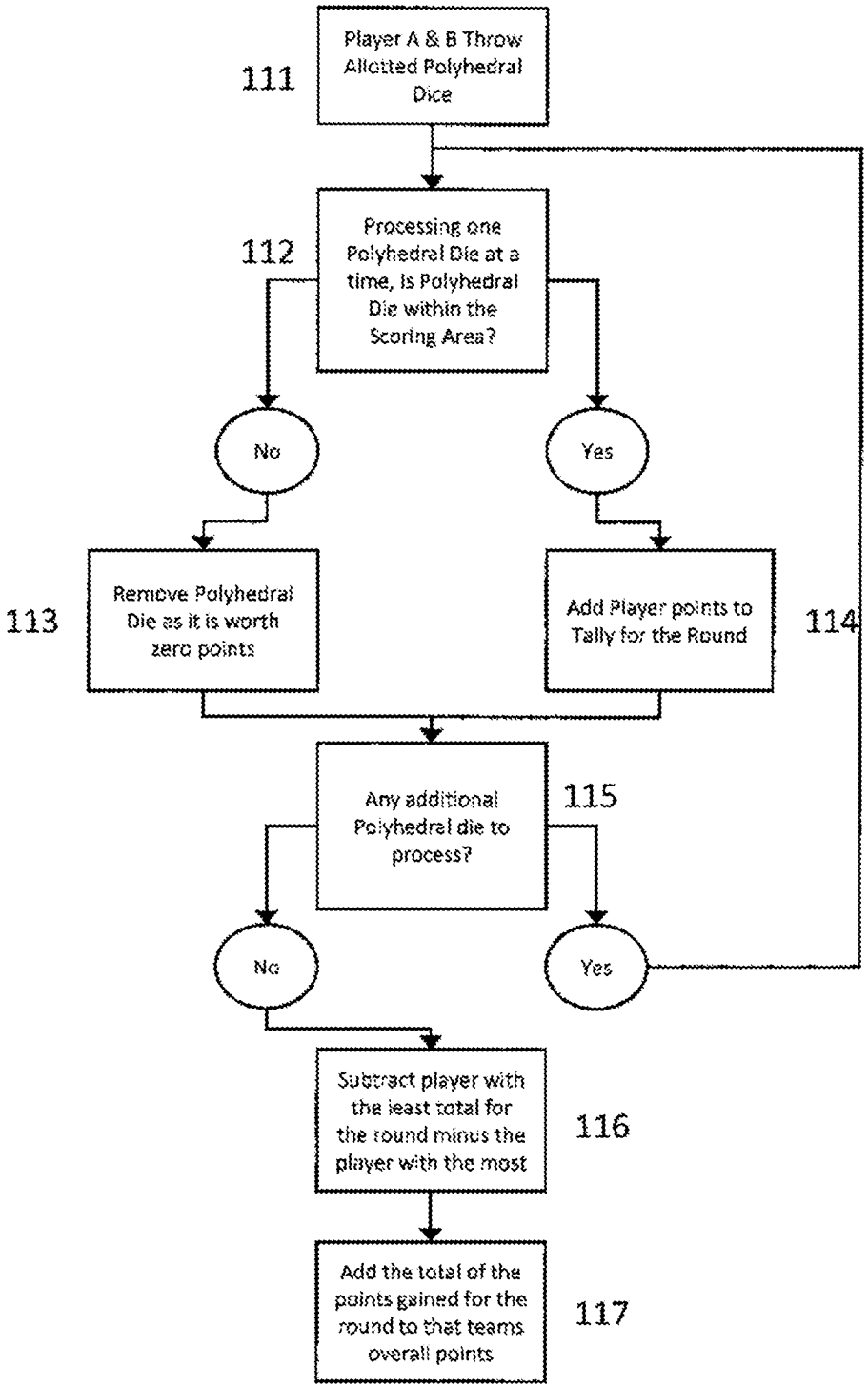
FIG. 4 is a flow chart showing a preferred cancellation scoring algorithm used in playing the board game.

After all dice have been exhausted for a round, a score is preferably determined according to the cancellation scoring algorithm illustrated in FIG. 4. In the scoring algorithm for one round as shown in FIG. 4, two players, labeled "A" and "B" throw their allotted number of dice (in Step 111) and then determine (in Step 112) if any dice are within the scoring area. If not, the game moves to the next round. If one or more dice are within the scoring area 20, one then begins to tally each players sum of points for the round (by repeating steps 112, 113, 114, and 115 as necessary). Once the sum of each player's points for the round is established, the player with the least amount of points for the round subtracts his points from the player with the most points for the round (in Step 116) and the resulting points are then added to that team's total points (in Step 117).

Scoring of this embodiment of the game includes a predetermined target score, e.g., twenty-one points, which must be reached for a player or team to win the game. Victory is achieved when a player's score equals or surpasses the target score and also leads the opponent by two or more points. The game continues until victory is achieved.

Modifications and variations of both the rules of the game and of the board apparatus provided in this embodiment disclosed herein can be made without departing from the subject and spirit of the invention. For example, a different shape playing surface or variation of size, shape and location of scoring area are suitable. Alternatively, differing arrangements, sizes and shapes of the barriers on the playing surface are employed to provide a game having differing probabilities of scoring. Moreover, scoring arrangements differing from the one that is taught are used if desired. Such modifications and variations are within the scope of the invention.

I claim:

1. An apparatus for playing a dice angle game, the apparatus comprising: (a) a playing surface with two sides and two ends; (b) two side walls along the sides of the playing surface;(c) two end walls along the ends of the playing surface, the side walls and the end walls defining an enclosed playing area with an open top; (d) two barriers at fixed positions within the playing area, each barrier being spaced apart from an adjacent end wall and being positioned an equal distance from each side wall, each barrier extending between the sides a distance that defines a width and extending between the ends a distance that defines a depth and wherein the width exceeds the depth; (e) two demarcated scoring areas, each scoring area being located between a barrier and an adjacent end wall, and each scoring area having a border defined in part by the barrier; and (f) a plurality of dice; wherein each scoring area includes a recess of sufficient size for a dice to enter; and wherein the playing surface has no barriers other than the two barriers forming a part of the border of the scoring areas.

2. The apparatus of claim 1 wherein the playing surface is rectangular and flat.

3. The apparatus of claim 1 wherein each barrier comprises a wall that is parallel to an adjacent end wall.

4. The apparatus of claim 3 wherein the side walls, the end walls, and the barriers have heights that are equal.

5. The apparatus of claim 4 wherein the side walls and end walls have lengths and wherein the lengths of the side walls are two to five times the lengths of the end walls.

* * * * *